US008925288B2

(12) United States Patent
Ghini et al.

(10) Patent No.: US 8,925,288 B2
(45) Date of Patent: Jan. 6, 2015

(54) PACKING METHOD AND UNIT FOR FOLDING A SHEET OF PACKING MATERIAL ABOUT AN ARTICLE SUCH AS A GROUP OF CIGARETTES

(75) Inventors: Marco Ghini, Monte San Pietro (IT); Roberto Polloni, Modigliana (IT); Andrea Biondi, Bologna (IT)

(73) Assignee: G.D Societa'per Azioni, Bologna (IT)

( * ) Notice: Subject to any disclaimer, the term of this patent is extended or adjusted under 35 U.S.C. 154(b) by 1012 days.

(21) Appl. No.: 13/056,689

(22) PCT Filed: Jul. 28, 2009

(86) PCT No.: PCT/EP2009/059761

§ 371 (c)(1), (2), (4) Date: Aug. 31, 2011

(87) PCT Pub. No.: WO2010/012738

PCT Pub. Date: Feb. 4, 2010

(65) Prior Publication Data

US 2011/0302886 A1 Dec. 15, 2011

(30) Foreign Application Priority Data

Jul. 29, 2008 (IT) ..... BO2008A0468

(51) Int. Cl.
*B65B 11/32* (2006.01)

(52) U.S. Cl.
USPC ..... 53/225; 53/206; 53/220; 53/224; 53/228; 53/464; 53/466

(58) Field of Classification Search
USPC ..... 53/220–225, 228, 232, 234, 206, 444, 53/461, 464, 466
IPC ..... B65B 11/06,11/28, 11/30, 11/32, 11/48
See application file for complete search history.

(56) References Cited

U.S. PATENT DOCUMENTS 4,144,695 A 3/1979 Seragnoli
4,843,798 A * 7/1989 Focke et al. ..... 53/453

(Continued)

FOREIGN PATENT DOCUMENTS

DE 2439192 A1 3/1976
EP 0519402 A1 12/1992

(Continued)

OTHER PUBLICATIONS

International Search Report in PCT Application No. PCT/EP2009/059761, dated Dec. 2, 2009.

*Primary Examiner* — Christopher Harmon
(74) *Attorney, Agent, or Firm* — Marshall, Gerstein & Borun LLP

(57) ABSTRACT

A packing method and unit (11) for folding a sheet (3) of packing material about a group (2) of cigarettes, and having: a first packing conveyor (12) having a first pocket (14) for receiving the group (2) wrapped in the tubular-folded sheet (3) of packing material; a second packing conveyor (18) having a second pocket (20) for receiving the group (2) wrapped in the tubular-folded sheet (3) of packing material; and a transfer device (24) which transfers the group (2), wrapped in the tubular-folded sheet (3) of packing material, from the first pocket (14) to the second pocket (20), and has a pusher (26) located at the first pocket (14) and engaging a first base wall (4) of the group (2), and a counter-pusher (27) located at the second pocket and engaging a second base wall (4), opposite the first base wall (4), of the group (2); the pusher (26) and/or the counter-pusher (27) of the transfer device (24) having respective lateral appendixes (28) which engage minor lateral walls (6) of the group (2), when the pusher (26) and counter-pusher (27) rest on the respective base walls (4) of the group (2), to fold portions (9) of the tubular sheet (3) of packing material onto the minor lateral walls (6) of the group (2).

10 Claims, 6 Drawing Sheets

(56) References Cited

U.S. PATENT DOCUMENTS

| | | | | |
|---|---|---|---|---|
| 4,947,617 | A * | 8/1990 | Focke et al. | 53/234 |
| 6,219,995 | B1 * | 4/2001 | Boldrini et al. | 53/234 |
| 6,643,996 | B2 * | 11/2003 | Spatafora et al. | 53/466 |
| 8,037,664 | B2 * | 10/2011 | Squarzoni et al. | 53/466 |
| 2002/0189208 | A1 * | 12/2002 | Spatafora | 53/466 |

FOREIGN PATENT DOCUMENTS

| | | | |
|---|---|---|---|
| GB | 1510192 | A | 5/1978 |
| GB | 2220911 | A | 1/1990 |

* cited by examiner

PACKING METHOD AND UNIT FOR FOLDING A SHEET OF PACKING MATERIAL ABOUT AN ARTICLE SUCH AS A GROUP OF CIGARETTES

CROSS-REFERENCE TO RELATED APPLICATIONS

This is the U.S. national phase application of International Application No. PCT/EP2009/059761, filed Jul. 28, 2009, which claims the benefit of Italian Patent Application No. B02008A 000468, filed Jul. 29, 2008.

TECHNICAL FIELD

The present invention relates to a packing method and unit for folding a sheet of packing material about a group of cigarettes.

BACKGROUND ART

A packet of cigarettes normally comprises an inner package defined by a group of cigarettes wrapped in a sheet of packing material (normally foil with no glue); and an outer package, which encloses the inner package, is stabilized using glue, may be cup-shaped and defined by a sheet of outer packing material folded about the inner package (soft packet of cigarettes), or may be defined by a rigid, hinged-lid box formed by folding a rigid blank about the inner package (rigid packet of cigarettes).

To fold a sheet of packing material about a group of cigarettes, a packing unit is known comprising two or more packing wheels, which have respective peripheral pockets for receiving and housing the group of cigarettes as the sheet of packing material is being folded. Normally, at a feed station, a group of cigarettes is inserted into a pocket on a first packing wheel together with a sheet of packing material, which folds into a U about the group of cigarettes; and the two flaps of the U-folded sheet of packing material projecting from the pocket are then folded one on top of the other and onto the group of cigarettes to form a tubular sheet of packing material. At a transfer station between the first packing wheel and a second packing wheel, the group of cigarettes enclosed in the tubular sheet of packing material is transferred from a pocket on the first packing wheel to a pocket on the second packing wheel; and folding devices fitted to the second packing wheel then perform further folding operations on the tubular sheet of packing material.

The group of cigarettes enclosed in the tubular sheet of packing material is transferred using a pusher which engages a first base wall of the group of cigarettes, and a counter-pusher which engages a second base wall, opposite the first base wall, of the group of cigarettes. In other words, the pusher and the counter-pusher grip the group of cigarettes between them as it is being transferred, to hold the group firmly together (i.e. to prevent undesired transverse movements of the cigarettes in the group, that may alter the shape of the group). Despite the gripping action of the pusher and counter-pusher, however, a far from negligible percentage of the groups of cigarettes have been found to undergo deformation as they are transferred between the two packing wheels, thus inevitably resulting in rejection of the groups.

DISCLOSURE OF THE INVENTION

It is an object of the present invention to provide a packing method and unit for folding a sheet of packing material about a group of cigarettes, and which are cheap and easy to implement and provide for eliminating the aforementioned drawbacks.

According to the present invention, there are provided a packing method and unit for folding a sheet of packing material about a group of cigarettes, as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
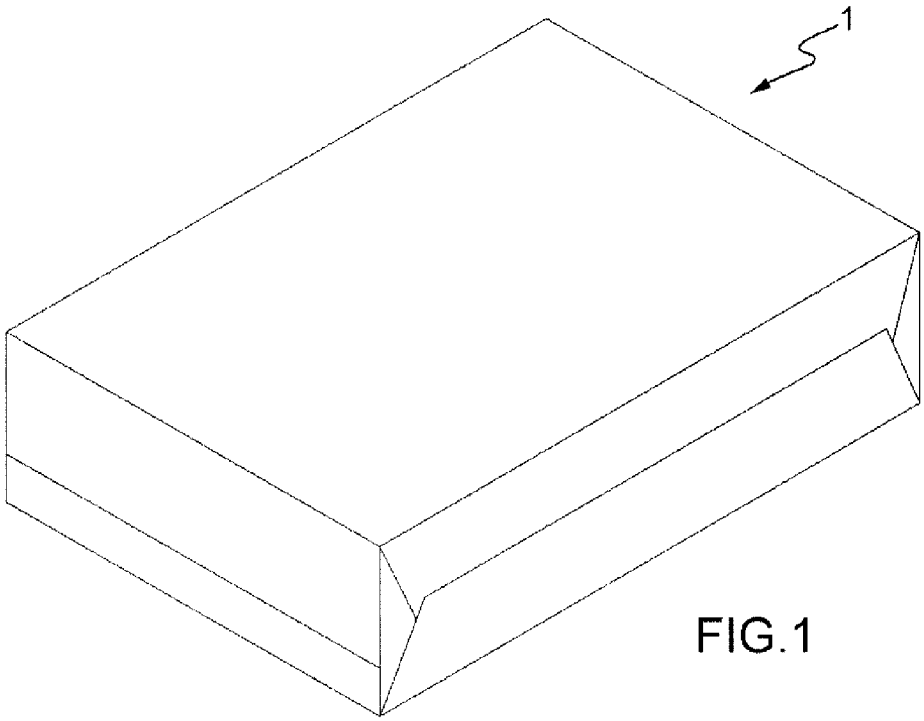
FIG. 1 shows a view in perspective of a package of cigarettes defined by a group of cigarettes wrapped in a sheet of packing material.
Figure 2:
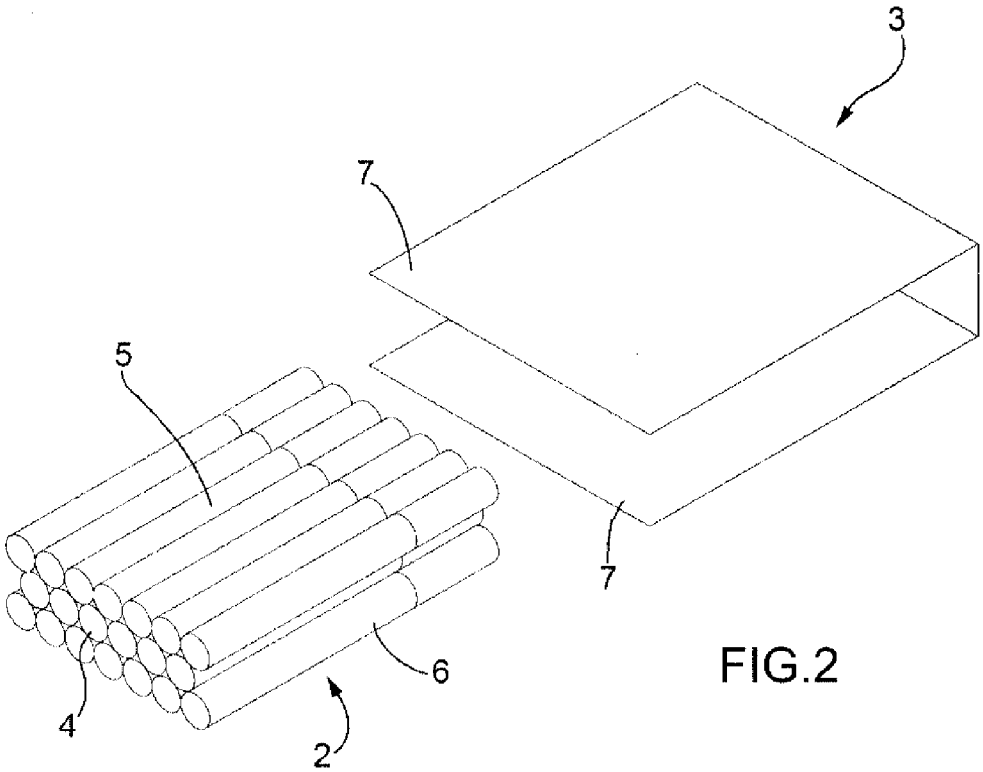
FIGS. 2, 3 and 4 show views in perspective of two steps in folding the sheet of packing material about the group of cigarettes to form the FIG. 1 package of cigarettes.

Number 1 in FIG. 1 indicates as a whole a package of cigarettes comprising a parallelepiped-shaped group 2 of cigarettes (shown in FIG. 2) wrapped in a sheet 3 of foil packing material (shown more clearly in FIG. 2). Once sheet 3 of packing material is folded about group 2 of cigarettes to form package 1, the shape of package 1 is stabilized by gluing or heat sealing the superimposed portions of sheet 3 of packing material. Alternatively, package 1 may not be stabilized, e.g. because it is eventually to be inserted inside an outer package (not shown).

As shown in FIG. 2, group 2 of cigarettes comprises two opposite base walls 4 (only one shown in FIG. 2) defined by the ends of the cigarettes; two opposite major lateral walls 5 (only one shown in FIG. 2) defined by the cylindrical lateral walls of the cigarettes; and two opposite minor lateral walls 6 (only one shown in FIG. 2) defined by the cylindrical lateral walls of the cigarettes.

Figure 3:
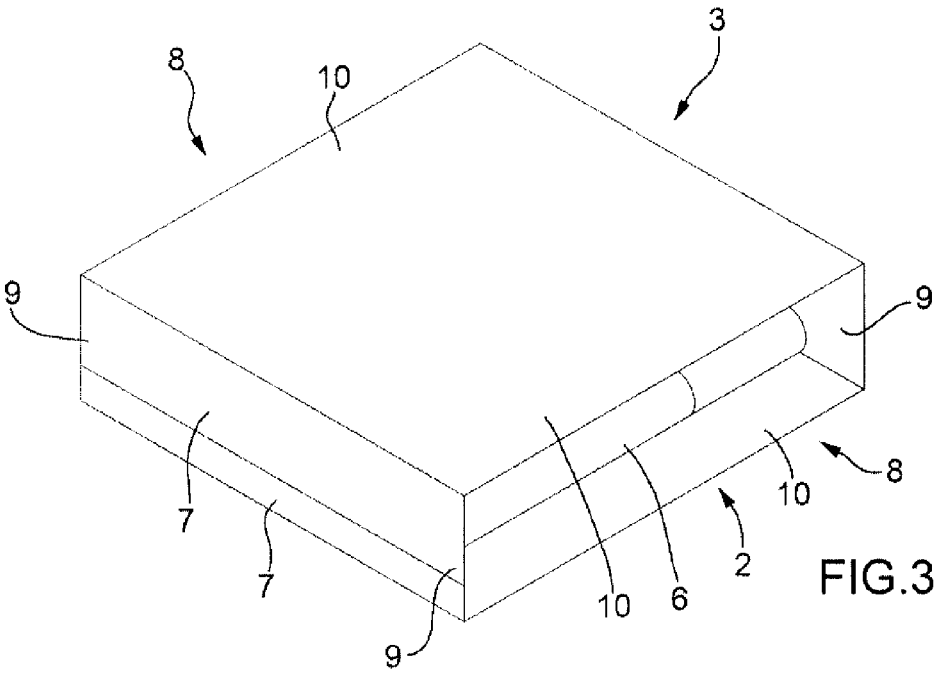
Figure 4:
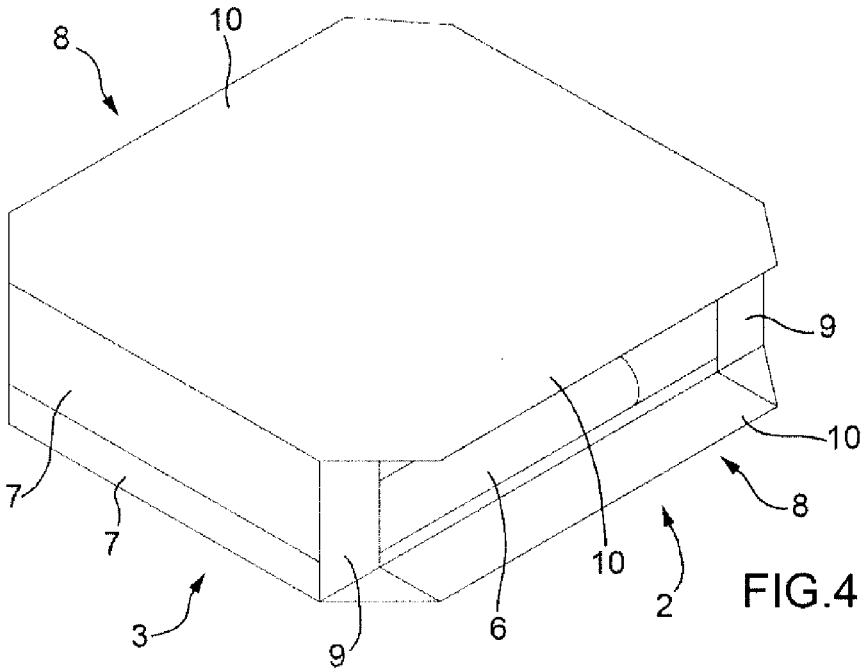

As shown in FIGS. 2 and 3, folding sheet 3 of packing material about group 2 of cigarettes comprises folding sheet 3 of packing material into a U about group 2 of cigarettes, and then folding one on top of the other and onto a base wall 4 of group 2 of cigarettes two flaps 7 of the U-folded sheet 3 of packing material projecting from base wall 4, so as to form a tubular sheet 3 of packing material (FIG. 3) having two open lateral ends 8 at the minor lateral walls 6 of group 2 of cigarettes. As shown in FIG. 4, four portions 9 of the open lateral ends 8 of the tubular sheet 3 of packing material are first folded onto minor lateral walls 6 of group 2 of cigarettes. That is, the portions 9 of open lateral ends 8 of tubular sheet 3 of packing material coplanar with the base walls 4 of group 2 of cigarettes are folded 90° onto minor lateral walls 6 of group 2 of cigarettes, and about minor transverse edges of base walls 4 of group 2 of cigarettes. Once portions 9 are folded, the other flaps 10 of open lateral ends 8 of tubular sheet 3 of packing material are folded one on top of the other and onto minor lateral walls 6 of group 2 of cigarettes to complete folding sheet 3 of packing material and form package 1 as shown in FIG. 1.

Figure 5:
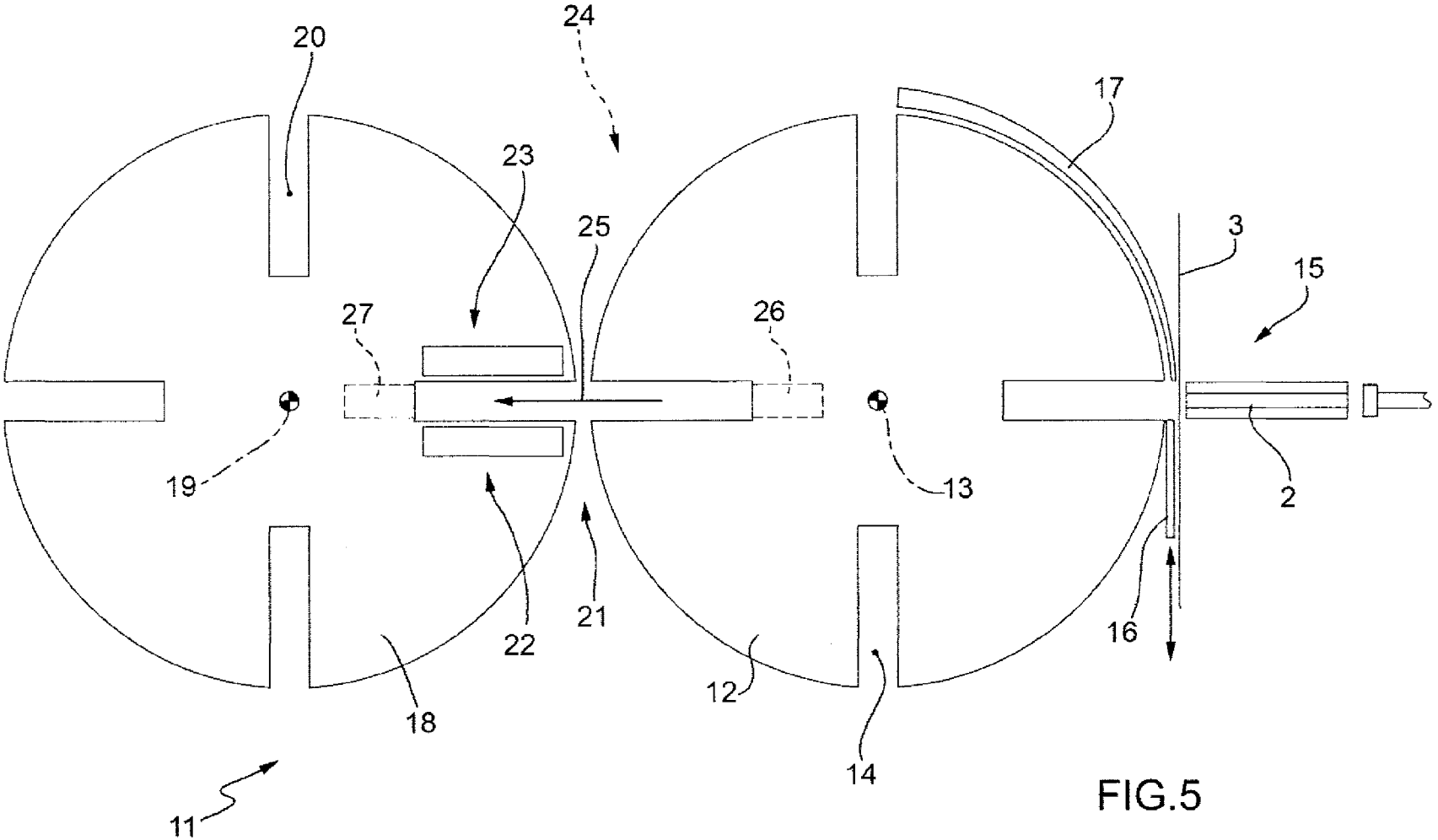
FIG. 5 shows a schematic front view, with parts removed for clarity, of a packing unit for producing the FIG. 1 package of cigarettes and in accordance with the present invention.
Figure 6:
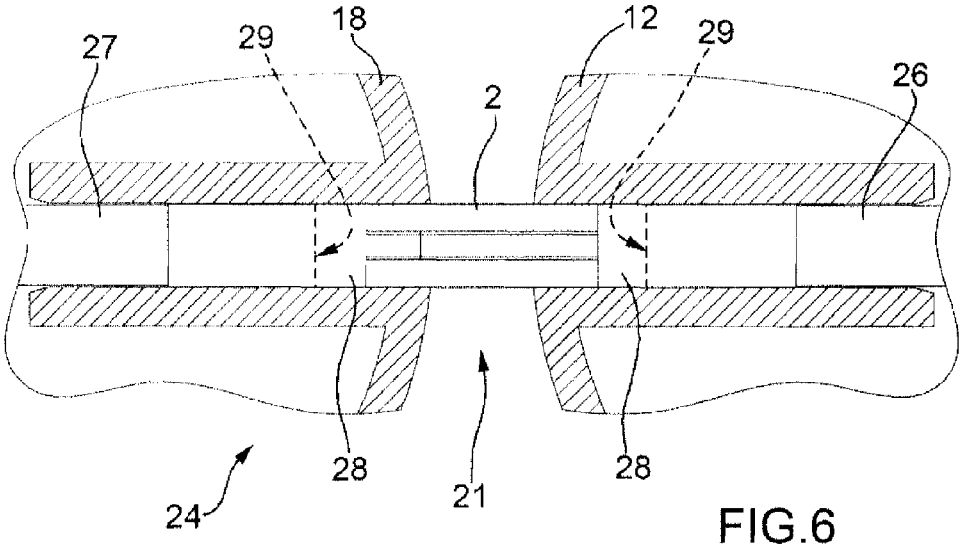
FIG. 6 shows a larger-scale front view of a transfer station between two packing wheels of the FIG. 5 packing unit.
Figure 7:
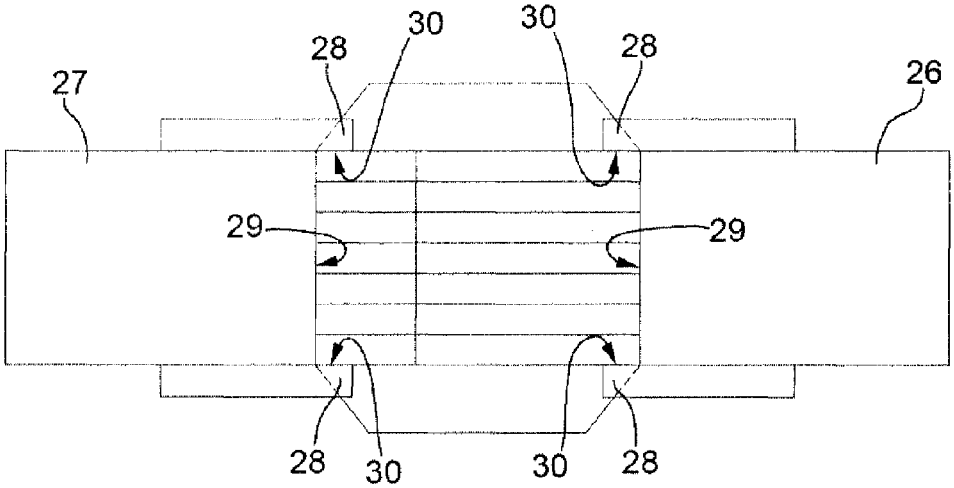
FIG. 7 shows a larger-scale plan view of the FIG. 6 transfer station.

Number 11 in FIG. 5 indicates as a whole a packing unit for folding a respective sheet 3 of packing material about each group 2 of cigarettes to form a package 1 as shown in FIG. 1. Packing unit 11 comprises a packing wheel 12 which rotates in steps (anticlockwise in FIG. 5) about a horizontal axis of rotation 13 and supports a number of peripheral seats 14, each for housing a group 2 of cigarettes.

At a feed station 15, each pocket 14 on packing wheel 12 receives a group 2 of cigarettes, which is pushed into pocket 14 by a pusher 15. Also at feed station 15, a flat sheet 3 of packing material, gummed beforehand if necessary, is fed, perpendicularly to the path of group 2 of cigarettes, into position in front of the inlet of pocket 14, so group 2 of cigarettes intercepts sheet 3 of packing material, thus folding sheet 3 of packing material into U about group 2 of cigarettes.

Once a group 2 of cigarettes, enclosed in a U-folded sheet 3 of packing material, is inserted inside a pocket 14, the two flaps 7 of the U-folded sheet 3 of packing material projecting from pocket 14 are folded one on top of the other and onto group 2 of cigarettes to form a tubular sheet 3 of packing material. More specifically, during a stop of packing wheel 12, a movable folder 16 folds the rear flap 7 (in the same direction as the rotation direction of packing wheel 12) onto group 2 of cigarettes; and, during the next forward movement of packing wheel 12, a fixed folder 17 folds the front flap 7 (in the opposite direction to the rotation direction of packing wheel 12) onto group 2 of cigarettes and on top of the already folded rear flap 7.

Packing unit 11 comprises a packing wheel 18 which is located alongside packing wheel 12, rotates in steps (anticlockwise in FIG. 5) about a horizontal axis of rotation 19 parallel to axis of rotation 13 of packing wheel 12, and supports a number of peripheral pockets 20, each for housing a group 2 of cigarettes. At a transfer station 21 between the two packing wheels 12 and 18, each group 2 of cigarettes enclosed in tubular sheet 3 of packing material is expelled from pocket 14 of packing wheel 12 into a pocket 20 of packing wheel 18.

Packing wheel 18 comprises a movable folder 22 which is located at transfer station 21, has two folding members (only one shown in FIG. 5) on opposite sides of pocket 20, and moves back and forth to fold the rear flaps 10 of open lateral ends 8 of tubular sheet 3 of packing material. Packing wheel 18 also comprises a fixed folder 23 which is located at transfer station 21, has two folding members (only one shown in FIG. 5) on opposite sides of pocket 20, and folds the front flaps 10 of open lateral ends 8 of tubular sheet 3 of packing material as step rotation of packing wheel 18 moves pocket 20 forward.

Transfer station 21 is equipped with a transfer device 24, which transfers group 2 of cigarettes, enclosed in tubular sheet 3 of packing material, from pocket 14 of packing wheel 12 to pocket 20 of packing wheel 18 in a transfer direction 25 perpendicular to axes of rotation 13 and 19. Transfer device 24 comprises a pusher 26 which is located at pocket 14 (i.e. at packing wheel 12), is mounted to move in transfer direction 25, and engages a base wall 4, located upstream in transfer direction 25, of group 2 of cigarettes. Transfer device 24 also comprises a counter-pusher 27 which is located at pocket 20 (i.e. at packing wheel 18), is mounted to move in transfer direction 25, and engages a base wall 4, located downstream in transfer direction 25 and opposite the upstream base wall 4, of group 2 of cigarettes.

To transfer group 2 of cigarettes enclosed in tubular sheet 3 of packing material, pusher 26 and counter-pusher 27 grip group 2 of cigarettes between them as it is being transferred. In other words, pusher 26 moves in transfer direction 25 into contact with the corresponding base wall 4 of group 2 of cigarettes, and, at the same time, counter-pusher 27 moves in the opposite direction to transfer direction 25 into contact with the corresponding base wall 4 of group 2 of cigarettes; at which point, pusher 26 and counter-pusher 27 grip group 2 of cigarettes between them and move together in transfer direction 25 to transfer group 2 of cigarettes from pocket 14 of packing wheel 12 to pocket 20 of packing wheel 18. Once group 2 of cigarettes is transferred, pusher 26 moves back to its original position behind pocket 14 of packing wheel 12, moving in the opposite direction to the transfer movement.

Pusher 26 and counter-pusher 27 of transfer device 24 comprise respective lateral appendixes 28 which, as pusher 26 and counter-pusher 27 come to rest on respective base walls 4 of group 2 of cigarettes, engage the minor lateral walls 6 of group 2 of cigarettes, thus folding portions 9 of sheet 3 of packing material onto minor lateral walls 6 of group 2 of cigarettes. More specifically, pusher 26 and counter-pusher 27 of transfer device 24 comprise respective end walls 29, each of which is parallel to and faces a respective base wall 4 of group 2 of cigarettes, rests against respective base wall 4 during transfer, and is flanked by the corresponding two lateral appendixes 28; and each lateral appendix 28 projects from its own end wall 29 towards the other end wall 29.

Figure 8:
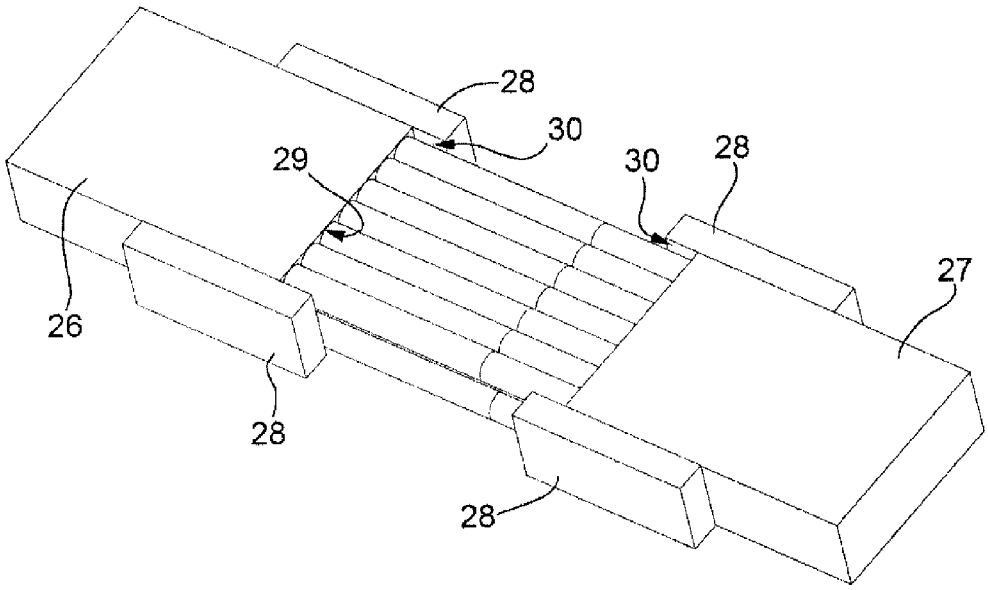
FIGS. 8 and 9 show two different schematic views in perspective, with parts removed for clarity, of a pusher and counter-pusher of the FIG. 6 transfer station.
Figure 9:
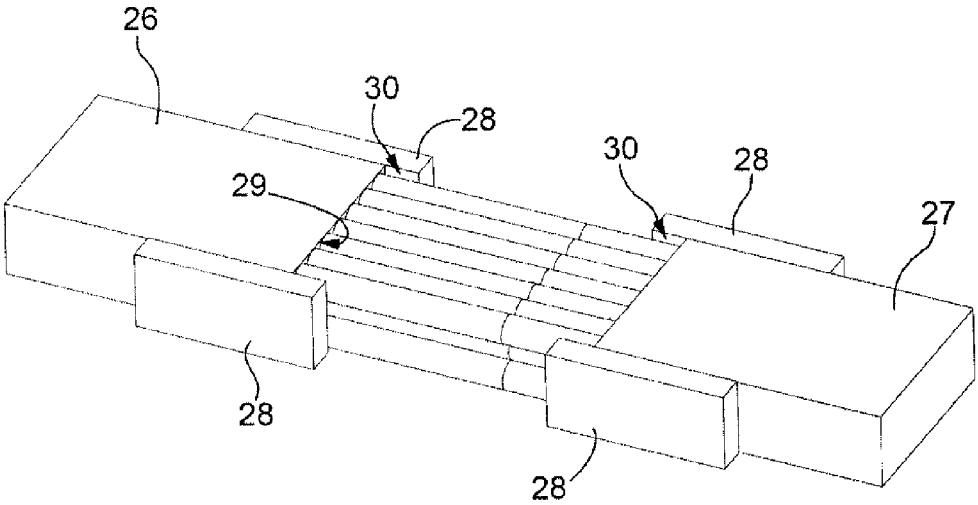

In the FIGS. 8 and 9 embodiment, each lateral appendix 28 is parallelepiped-shaped with a rectangular base, and has a flat folding wall 30 which holds respective portion 9 folded down and is parallel to transfer direction 25 and perpendicular to the corresponding base wall 4 of group 2 of cigarettes (i.e. perpendicular to corresponding end wall 29). In a different embodiment not shown, each lateral appendix 28 is parallelepiped-shaped with a triangular base and with folding wall 30 along the hypotenuse.

Figure 10:
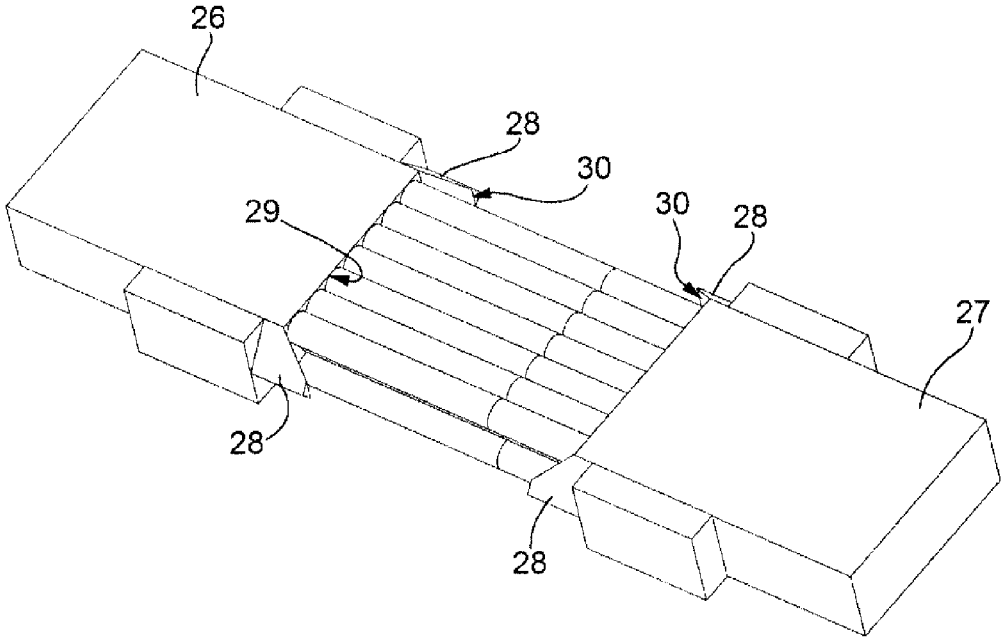
FIGS. 10 and 11 show two different schematic views in perspective, with parts removed for clarity, of a variation of the pusher and counter-pusher in FIGS. 8 and 9.
Figure 11:
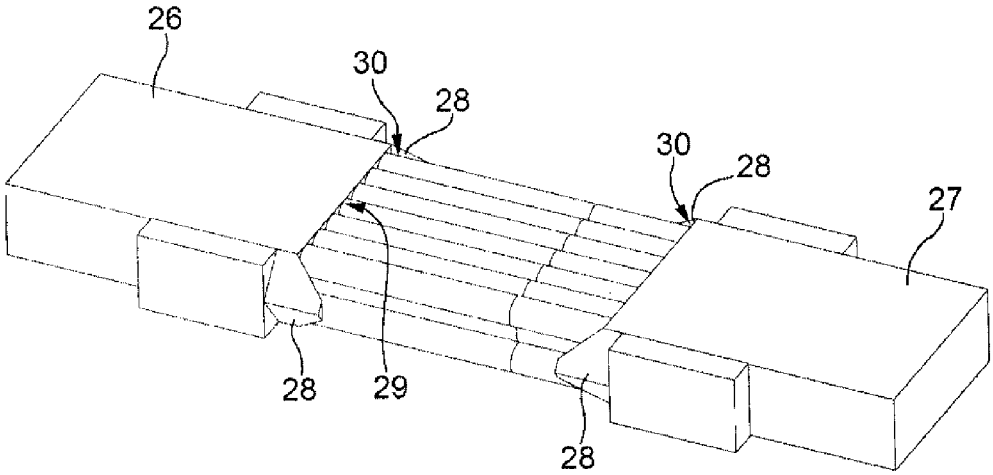

In the FIGS. 10 and 11 variation, each lateral appendix 28 is substantially truncated-pyramid-shaped with a triangular base and with folding wall 30 along the hypotenuse; in which case, folding wall 30 for holding respective portion 9 folded down is flat, forms an acute angle with transfer direction 25, and forms an obtuse angle with the corresponding base wall 4 of group 2 of cigarettes (i.e. forms an obtuse angle with the corresponding end wall 29).

It is important to note that the movement of pusher 26 and counter-pusher 27 is timed with the action of movable pusher 22 and fixed pusher 23, so that, when appendixes 28 disengage portions 9, folders 22 and 23 fold the open ends 8 of tubular sheet 3 of packing material over the folded portions 9 to prevent portions 9 from springing back up. In an alternative embodiment, appendixes 28 are designed so that flaps 10 of open lateral ends 8 of tubular sheet 3 of packing material can be folded over appendixes 28; in which case, flaps 10 of open lateral ends 8 of tubular sheet 3 of packing material are folded over appendixes 28, which are not withdrawn from group 2 of cigarettes until flaps 10 are at least partly folded.

In the preferred embodiment described, each sheet 3 of packing material is folded about a group 2 of cigarettes; in a different embodiment not shown, group 2 of cigarettes may be replaced by any parallelepiped-shaped article, such as a package of a food product.

Packing unit 11 described has numerous advantages. In particular, it is cheap and easy to produce, by only differing in minor respects, that are easy to implement, from similar known packing units. Moreover, in packing unit 11 described, group 2 of cigarettes, as it is transferred enclosed in tubular sheet 3 of packing material, is also retained laterally by lateral appendixes 28, and so undergoes no deformation or slippage as it is transferred between the two packing wheels 12 and 18. Finally, by virtue of lateral appendixes 28, portions 9 of tubular sheet 3 of packing material are folded onto group 2 of cigarettes as it is transferred between the two packing wheels 12 and 18, which means packing wheel 18 need not be equipped with specific folders for portions 9 of tubular sheet 3 of packing material, thus greatly simplifying the design of packing wheel 18.

The invention claimed is:

1. A packing unit for folding a sheet (3) of packing material about an article, such as a group (2) of cigarettes, and comprising:

a first packing conveyor (12) having a first pocket (14) for receiving the group (2) wrapped in the tubular-folded sheet (3) of packing material;

a second packing conveyor (18) having a second pocket (20) for receiving the group (2) wrapped in the tubular-folded sheet (3) of packing material; and a transfer device (24) which transfers the group (2), wrapped in the tubular-folded sheet (3) of packing material, from the first pocket (14) to the second pocket (20), and comprises a pusher (26) located at the first pocket (14) and engaging a first base wall (4) of the group (2); and a counter-pusher (27) located at the second pocket and engaging a second base wall (4), opposite the first base wall (4), of the group (2);

the packing unit being characterized in that the pusher (26) and/or the counter-pusher (27) of the transfer device (24) comprise respective lateral appendixes (28) which engage minor lateral walls (6) of the group (2), when the pusher (26) and counter-pusher (27) rest on the respective base walls (4) of the group (2), to fold portions (9) of the tubular sheet (3) of packing material onto the minor lateral walls (6) of the group (2).

2. A packing unit as claimed in claim 1, wherein the pusher (26) and counter-pusher (27) of the transfer device (24) comprise respective end walls (29), each of which is parallel to and faces a respective base wall (4) of the group (2), rests on the respective base wall (4) during transfer, and is flanked by the two corresponding lateral appendixes (28).

3. A packing unit as claimed in claim 2, wherein each lateral appendix (28) projects from the respective end wall (29) towards the other end wall (29).

4. A packing unit as claimed in claim 1, wherein each lateral appendix (28) is substantially parallelepiped-shaped with a rectangular base.

5. A packing unit as claimed in claim 1, wherein each lateral appendix (28) is substantially parallelepiped-shaped with a triangular base.

6. A packing unit as claimed in claim 1, wherein each lateral appendix (28) is substantially truncated-pyramid-shaped with a triangular base.

7. A packing unit as claimed in claim 1, each lateral appendix (28) has a folding wall (30) which holds the respective portion (9) folded down, is flat, is parallel to a transfer direction (25), and is perpendicular to the corresponding base wall (4) of the group (2).

8. A packing unit as claimed in claim 1, wherein each lateral appendix (28) has a folding wall (30) which holds the respective portion (9) folded down, is flat, forms an acute angle with a transfer direction (25), and forms an obtuse angle with the corresponding base wall (4) of the group (2).

9. A packing unit as claimed in claim 1, wherein the lateral appendixes (28) are designed so that flaps (10) of open lateral ends (8) of the tubular sheet (3) of packing material can be folded over the lateral appendixes (28); and the second packing conveyor (18) comprises folding devices (22, 23) for folding the flaps (10) of the open lateral ends (8) of the tubular sheet (3) of packing material over the lateral appendixes (28), which are not withdrawn from the group (2) until the flaps (10) are at least partly folded.

10. A packing method for folding a sheet (3) of packing material about an article, such as a group (2) of cigarettes, and comprising the steps of:

folding the sheet (3) of packing material into a tube about the group (2);

forward-feeding the group (2), wrapped in the tubular-folded sheet (3) of packing material, by means of a first packing conveyor (12) having a first pocket (14); and transferring the group (2), wrapped in the tubular-folded sheet (3) of packing material, from the first pocket (14) of the first packing conveyor (12) to a second pocket (20) of a second packing conveyor (18) by means of a transfer device (24), which comprises a pusher (26) located at the first pocket (14) and engaging a first base wall (4) of the group (2); and a counter-pusher (27) located at the second pocket and engaging a second base wall (4), opposite the first base wall (4), of the group (2);

the packing method being characterized by comprising the further step of engaging minor lateral walls (6) of the group (2) by means of respective lateral appendixes (28) of the pusher (26) and/or counter-pusher (27), when the pusher (26) and counter-pusher (27) rest on the respective base walls (4) of the group (2), so as to fold portions (9) of the tubular sheet (3) of packing material onto the minor lateral walls (6) of the group (2).

* * * * *

UNITED STATES PATENT AND TRADEMARK OFFICE

CERTIFICATE OF CORRECTION

PATENT NO. : 8,925,288 B2
APPLICATION NO. : 13/056689
DATED : January 6, 2015
INVENTOR(S) : Marco Ghini et al.

It is certified that error appears in the above-identified patent and that said Letters Patent is hereby corrected as shown below:

Claims

At Column 6, Line 7, Claim 7, "claim 1, each" should be -- claim 1, wherein each --.

Signed and Sealed this
Eighth Day of December, 2015

Michelle K. Lee

Michelle K. Lee
*Director of the United States Patent and Trademark Office*